United States Patent [19]

Anderson, deceased

[11] Patent Number: 4,487,239

[45] Date of Patent: Dec. 11, 1984

[54] HYDRAULIC WOOD SPLITTER WITH AUTOMATIC CABLE HOIST

[75] Inventor: Elga Anderson, deceased, Centertown, Mo., by Margaret Anderson, personal representative

[73] Assignee: Margaret A. Anderson, Centertown, Mo.

[21] Appl. No.: 330,093

[22] Filed: May 24, 1982

[51] Int. Cl.[3] ..... B27L 7/00

[52] U.S. Cl. ..... 144/193 A; 144/3 K; 414/744 R

[58] Field of Search ..... 144/3 K, 193 R, 193 A; 414/744 R, 744 A, 745

[56] References Cited

U.S. PATENT DOCUMENTS 4,351,378 9/1982 Smith ..... 144/193 A

*Primary Examiner*—W. D. Bray

*Attorney, Agent, or Firm*—Senniger, Powers, Leavitt and Roedel

[57] ABSTRACT

A hydraulic wood splitter with an automatic hoist for lifting logs onto the platform of the splitter. The splitter has a splitting wedge adjacent one end of the platform, and an extensible and retractible hydraulic ram on the platform spaced rearwardly from the splitting wedge for placement of a log lengthwise between the ram and the splitting wedge. The ram is extensible for pushing a log against the splitting wedge to split the log and retractible for placement of another log on the platform. The hoist comprises a boom extending up from the platform forward of the splitting wedge. The boom is pivoted on the platform on a generally vertical axis. Means for grasping a log to be split is supported by the boom and a cable and pulley system operable in conjunction with the ram for raising and lowering the grasping means. The system is operable for lowering the grasping means to grasp a log in response to extension of the ram and for raising the grasping means to hoist the log onto the platform in response to retraction of the ram.

6 Claims, 5 Drawing Figures

HYDRAULIC WOOD SPLITTER WITH AUTOMATIC CABLE HOIST

BACKGROUND OF THE INVENTION

This invention relates generally to a hydraulic wood splitter with a hoist and, more particularly, to a hydraulic wood splitter with a cable hoist which automatically operates in conjunction with the splitter to lift logs onto the splitter.

Due to the constantly increasing cost of electric and gas energy, many people have turned to burning wood as a means of heating a home. Hence, there is an increasing demand for splitting trees into firewood, particularly large diameter trees. However, present splitting devices require a crew of 2–4 men to lift and position the heavy logs for splitting. This is an inefficient use of manpower since only one individual is needed to operate the splitter itself. Reference may be made to U.S. Pat. No. 4,351,378 for a hydraulic log splitting assembly generally in the field of this invention.

SUMMARY OF THE INVENTION

Among the several objects of the invention may be noted the provision of a hydraulic wood splitter with an automatic cable hoist which enables a single operator to split logs without the aid of a crew to lift the log onto the splitter; the provision of such a hydraulic wood splitter which is simple and safe to use; and the provision of such a hydraulic wood splitter which is durable and inexpensive to manufacture.

In general, a hydraulic wood splitter with an automatic hoist of this invention is designed to enable a single individual to lift logs onto the splitter. The splitter includes a platform for supporting a log thereon in a generally horizontal position, a splitting wedge adjacent one end constituting the front end of the platform, and an extensible and retractible hydraulic ram on the platform spaced rearwardly from the splitting wedge for placement of a log lengthwise between the ram and the splitting wedge. The ram is extensible for pushing the log against the splitting wedge to split the log and retractible for placement of another log on the platform. The hoist comprises a boom extending up from the platform generally forward of the splitting wedge. The boom is pivoted on the platform on a generally vertical axis. Means for grasping a log to be split is supported by the boom and a cable and pulley system is operable in conjunction with the ram for raising and lowering the grasping means. The system is operable for lowering the grasping means to grasp a log in response to extension of the ram and for raising the grasping means to hoist the log onto the platform in response to retraction of the ram.

Other objects and features will be in part apparent and in part pointed out hereinafter.

BRIEF DESCRIPTION OF THE DRAWINGS

Corresponding reference characters indicate corresponding parts throughout the several views of the drawings.

DESCRIPTION OF THE PREFERRED EMBODIMENT

Figure 1:
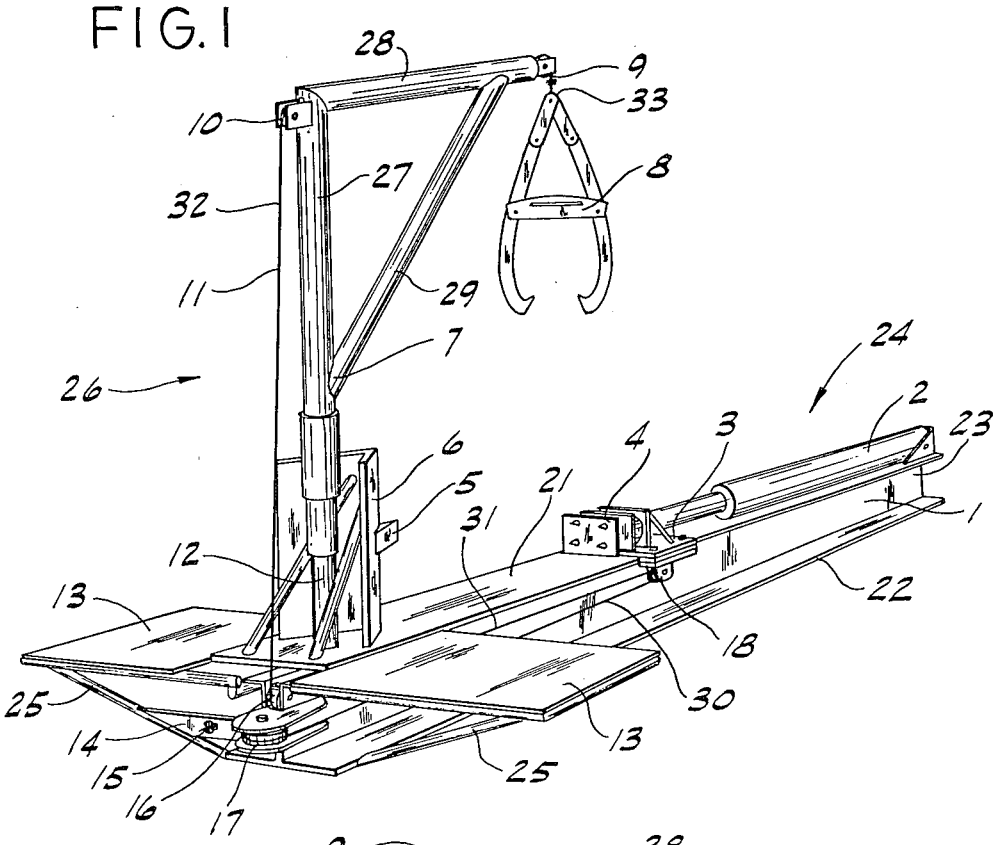
FIG. 1 is a right side perspective of a hydraulic wood splitter with an automatic cable hoist of the present invention.

The drawings depict a hydraulic wood splitter with an automatic hoist for lifting logs onto the splitter. The splitter includes a beam 1 which is I-shaped in cross-section having a horizontal upper flange 21, a horizontal lower flange 22 and a vertical web 23. The upper flange 21 constitutes a platform for supporting a log (not shown) thereon in generally a horizontal position. The beam 1 is of heavy-duty construction for supporting logs weighing up to 400 pounds. A splitting wedge 6 is suitably secured (e.g., welded) and braced to the platform 21 adjacent the front end (its left end as reviewed in FIG. 1) of the platform. The wedge 6 has a small leading wedge 5 welded thereto to further assist in splitting a log. An extensible and retractible hydraulic ram 24 is suitably secured on the platform 21 generally near the back end thereof. The ram 24 includes a hydraulic ram cylinder 2, a hydraulic cylinder slide 3 and a press head 4. The press head 4 has short spikes extending therefrom for obtaining a "bite" on a log as will be described later. The pump, oil reservoir and hydraulic controls used to operate the ram 24 are located generally to the rear of the hydraulic cylinder 2 but are not shown. The hydraulic pump may be powered by the standard power-take-off of a tractor.

The ram 24 is spaced rearwardly from the splitting wedge 6 a sufficient distance so that a log can be placed lengthwise between the ram press head 4 and the splitting wedge 6 when the ram is in a retracted position. As will be understod by those familiar with the art, the ram 24 is extensible for pushing a log against the splitting wedge 6 in order to split the log and retractible for the placement of another log on the platform 1. Holding tables 13 are suitably mounted at the front end of the platform 21 generally adjacent the wedge for catching splits of wood. The tables 13 are supported by braces 25 angling between the lower flange 22 of the I-beam and the tables. It will be understood that the splitter may be mounted on a suitable trailer for pulling it from location to location.

The hoist 26 comprises a boom 7 extending up from the platform 1 generally forward of the splitting wedge 6. The boom 7 comprises a generally vertical tubular post 27 mounted on a spindle 12 affixed to the platform 21 for pivoting of the boom on a generally vertical axis. The post 27 has an arm 28 which projects laterally outwardly (rearwardly as shown in the drawings) therefrom adjacent the upper end of the post. A brace 29 supports the arm 28 for lifting heavy logs. Log tongs 8, constituting means for grasping a log to be split, are supported by the boom at the outer (free) end of arm 27.

Hoist 26 further comprises a cable and pulley system which is operable in conjunction with the ram 24 for raising and lowering the log tongs 8. The cable and pulley system comprises pulleys 9, 10, 16, 17, 18 and 20, and a cable 11. Pulley 18 is attached to the hydraulic cylinder slide 3 of ram 24 and is rotatable about a generally horizontal axis extending transversely with respect to the I-beam. Pulley 16 is mounted on platform 21 adjacent the bottom of the boom 7 forward of spindle 12 for rotation about a generally horizontal axis extending generally transversely with respect to beam 1. Pulley 10 is located adjacent the inner end of arm 28 and pulley 9 adjacent the outer end of the arm. Both are rotatable about generally horizontal axes extending transversely with respect to the arm 28. Pulley 17 is suitably secured to the web 23 of the I-beam 1 at the front end of the beam for rotation on a generally vertical axis, and pulley 20 is located at one side of the web 23 (its left side as viewed in FIG. 1) adjacent pulley 17.

Figure 2:
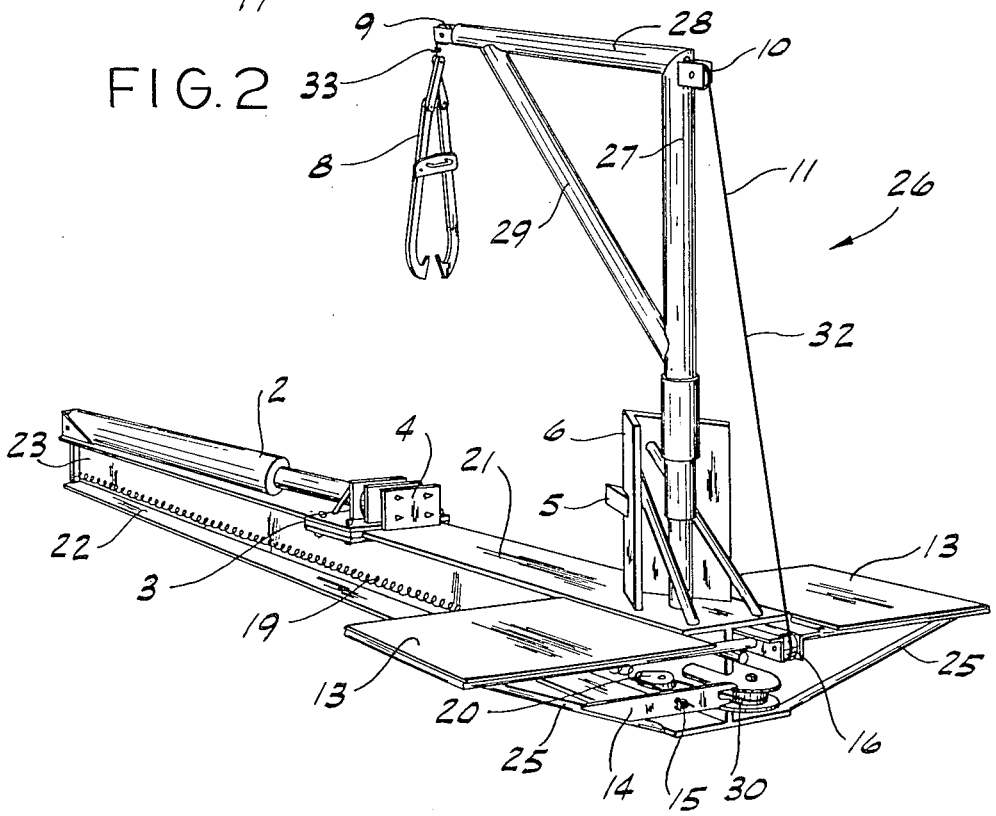
FIG. 2 is a left side perspective of the splitter.
Figure 4:
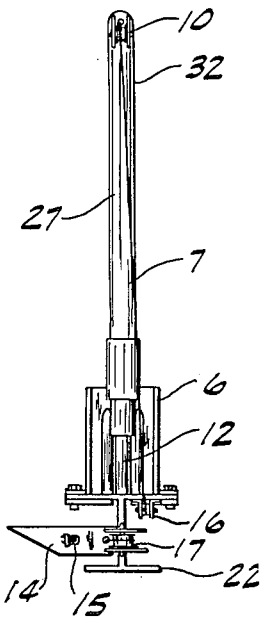
FIG. 4 is a front elevation of the splitter.

Cable 11 is of wire or other material of suitable strength and has a fixed connection 15 (e.g., a cable clamp connection) at one end to a cable stop bar 14 and a fixed connection 33 at its other end to the log tongs 8. Stop bar 14 is secured at one end to brace 25 and at the other end to pulley 17, as shown in FIG. 2. The cable 11 has a first reach 30 extending horizontally rearwardly from connection 15 to pulley 20, then horizontally forwardly to pulley 17 (which constitutes an idler pulley), and then generally horizontally rearwardly from pulley 17 to the ram pulley 18. The cable 11 also includes a second reach 31 extending generally horizontally forwardly from the ram pulley 18 to pulley 16 adjacent the bottom of the boom, and a third reach 32 extending upwardly from pulley 16 toward the fixed connection 33 with the log tongs. Pulley 10 directs the third cable reach 32 outwardly along arm 28 and pulley 9 directs the third cable reach 32 downwardly to the fixed connection 33 with the log tongs 8.

Figure 3:
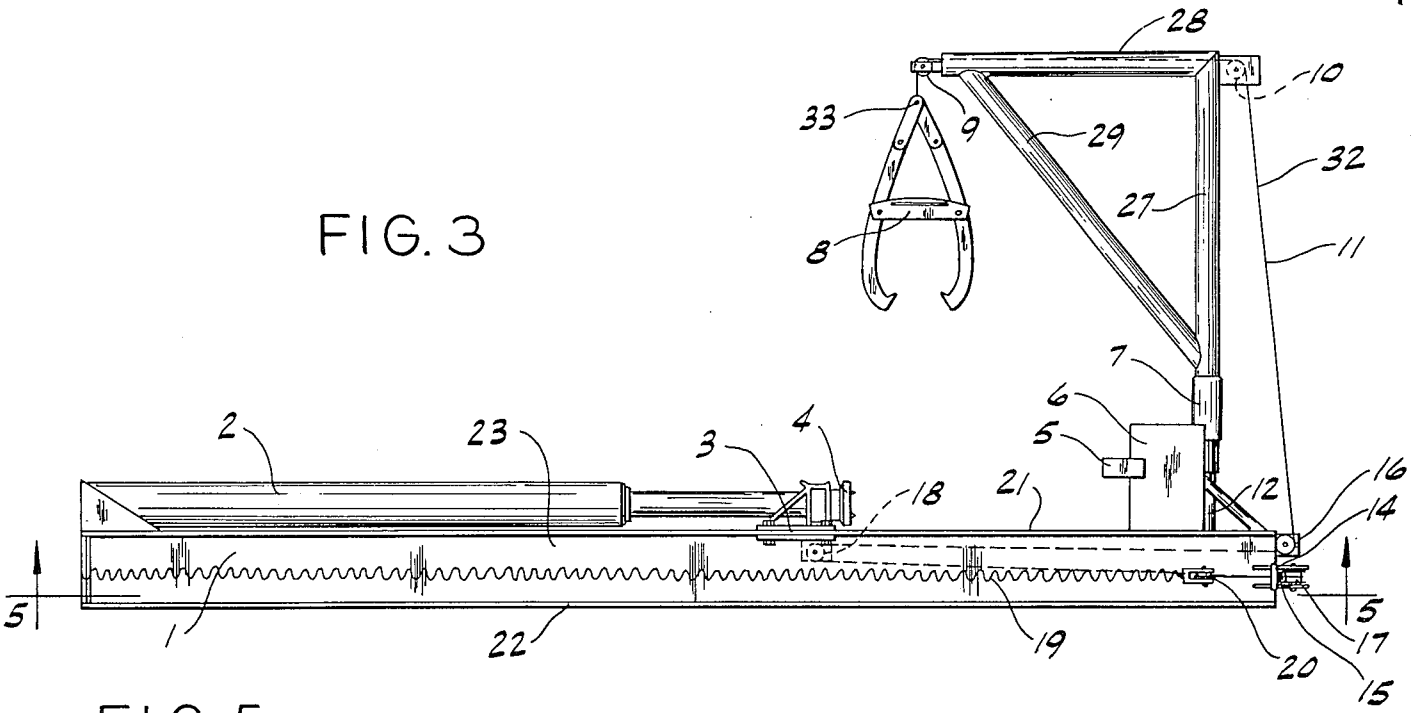
FIG. 3 is a left side elevation of the splitter.
Figure 5:
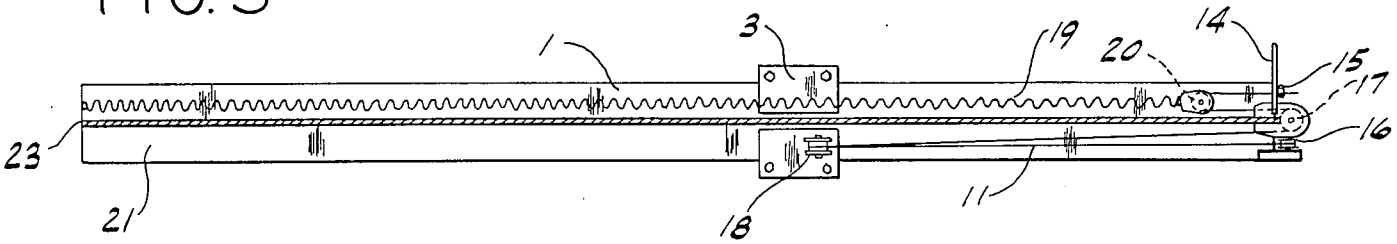
FIG. 5 is a section on line 5—5 of FIG. 3.

A coil tension spring 19, constituting means for biasing the grasping means 8 toward a raised position, is suitably attached at one end to pulley 20 (which may thus be referred to as a tensioning pulley) and at its other end to the back end of beam 1 generally at the web 23 as shown in FIGS. 2, 3 and 5. The spring 19 biases the tensioning pulley 20 rearwardly for pulling the cable 11 to keep the log tongs 8 in a raised position when they are not attached to a log. The length and tension of the spring 19 is such that when the ram 24 is in an extended position there is a distance between pulley 20 and stop bar 14 sufficient to allow the tongs to be pulled down below beam 1. In addition, the tension is not so great that the tongs 8 cannot readily be pulled downwardly.

To operate the splitter, the hydraulic ram cylinder 2 is extended and the boom 7 pivoted to where the tongs 8 are positioned over a log adjacent the splitter. The tongs are then secured to a log by pulling the tongs downwardly against the light pressure from the coil tension spring 19. This pressure from the spring 19 also keeps the tongs 8 gripped to the log while the operator returns to the hydraulic controls at the back of the beam 1. The hydraulic ram is then slowly retracted thereby causing the ram pulley 18, due to the weight of the log, to move rearwardly and thus pull the tension spring pulley 20 against the cable stop bar 14. When pulley 20 comes in contact with bar 14, the tongs 8 and log start their movement toward the top of the boom 7. Once the log is raised to a height greater than that of the beam 1 and the distance between the head 4 and the wedge 6 is greater than the length of the log, the operator halts the retraction of the ram 24 and swings the boom to position the log over the platform 1. The operator then returns to the hydraulic controls and begins to slowly extend the ram, thereby lowering the log. Once the log is positioned lengthwise on the platform 1, it is clamped into position between the press head 4 and the leading wedge 6 by further extension of the ram, thereby allowing the spikes on the press head 4 to "bite" into the log. The tongs 8 are then removed from the log and the coil tension spring 19 automatically lifts them out of the way. The hydraulic ram then is extended further, thereby pushing the log against the splitting wedge to split the log into pieces, which are left lying on the holding tables 13.

Hence, it will be understood from the above that a single individual can easily perform log splitting operations of heavy logs without the aid of a crew to lift and position heavy logs on the platform.

In view of the above, it will be seen that the several objects of the invention are achieved and other advantageous results attained.

As various changes could be made in the above construction without departing from the scope of this invention, it is intended that all matter contained in the above description or shown in the accompanying drawings shall be interpreted as illustrative and not in a limiting sense.

What is claimed is:

1. A hydraulic wood splitter with an automatic hoist for lifting logs onto the splitter, the splitter including a platform for supporting a log thereon in generally horizontal position, a splitting wedge adjacent one end constituting the front end of the platform, and an extensible and retractible hydraulic ram on the platform spaced rearwardly from the splitting wedge for placement of a log lengthwise between the ram and the splitting wedge, said ram being extensible for pushing said log against said splitting wedge to split the log and retractible for placement of another log on the platform, said hoist comprising:

a boom extending up from the platform generally forward of said splitting wedge, said boom being pivoted on the platform on a generally vertical axis;

means supported by the boom for grasping a log to be split; and a cable and pulley system operable in conjunction with the ram for raising and lowering said grasping means, said system being operable for lowering said grasping means to grasp a log in response to extension of said ram and for raising said grasping means to hoist the log onto the platform in response to retraction of the ram.

2. A hydraulic wood splitter as set forth in claim 1 further comprising means for biasing said grasping means toward a raised position.

3. A hydraulic wood splitter as set forth in claim 2 wherein said cable and pulley system comprises a pulley attached to the ram, a pulley adjacent the bottom of the boom, and a cable having a fixed connection at one end with the platform and a fixed connection at its other end with said grasping means, said cable having a first reach, a portion of which extends generally rearwardly to said ram pulley, a second reach extending generally forwardly from said ram pulley to said pulley adjacent the bottom of the boom, and a third reach extending upwardly from the latter pulley toward said fixed connection with grasping means.

4. A hydraulic wood splitter as set forth in claim 3 wherein said boom comprises a generally vertical post having an arm projecting laterally outwardly therefrom adjacent its upper end.

5. A hydraulic wood splitter as set forth in claim 4 wherein said cable and pulley system further includes a pulley adjacent the inner end of said arm directing said third cable reach outwardly along said arm and a pulley adjacent the outer end of the arm directing said third cable reach downwardly to said fixed connection with said grasping means.

6. A hydraulic wood splitter as set forth in claim 3 wherein said cable and pulley system further comprises a tensioning pulley and an idler pulley, said first cable reach extending generally rearwardly from said fixed platform cable connection to said tensioning pulley, and generally forwardly from said tensioning to said idler pulley, said portion of said first cable reach extending generally rearwardly from said idler pulley to said ram pulley.

* * * * *